US007607845B2

(12) United States Patent
Mizutani

(10) Patent No.: US 7,607,845 B2
(45) Date of Patent: Oct. 27, 2009

(54) PRINTING DEVICE THAT RELIABLY FEEDS RECORDING MEDIUM FROM FEEDING CASSETTE TO CONVEYING ROLLER

(75) Inventor: Shunsuke Mizutani, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 0 days.

(21) Appl. No.: 11/711,601

(22) Filed: Feb. 28, 2007

(65) Prior Publication Data

US 2007/0201935 A1 Aug. 30, 2007

(30) Foreign Application Priority Data

Feb. 28, 2006 (JP) ..... 2006-052972

(51) Int. Cl.
*B41J 11/58* (2006.01)

(52) U.S. Cl. ..... 400/624; 400/625; 400/636; 400/636.1

(58) Field of Classification Search ..... 400/624, 400/625, 636, 636.1, 636.2
See application file for complete search history.

(56) References Cited

U.S. PATENT DOCUMENTS 5,562,354 A * 10/1996 Aizawa et al. ..... 400/625
5,672,019 A 9/1997 Hiramatsu et al.
5,846,007 A * 12/1998 Nakayama et al. ..... 400/624
5,882,129 A * 3/1999 Nakayama ..... 400/618
5,993,085 A * 11/1999 Nakayama et al. ..... 400/55
6,893,174 B2 * 5/2005 Askren et al. ..... 400/582

FOREIGN PATENT DOCUMENTS

| | | |
|---|---|---|
| JP | 6026539 | 2/1985 |
| JP | 63180679 | 7/1988 |
| JP | 5-155086 | 6/1993 |
| JP | 6115731 | 4/1994 |
| JP | 6271145 | 9/1994 |
| JP | 9-052421 | 2/1997 |

OTHER PUBLICATIONS

Office Action issued on Dec. 24, 2008 in corresponding Japanese Application No. 2006-052972.

* cited by examiner

*Primary Examiner*—Judy Nguyen
*Assistant Examiner*—Matthew G Marini
(74) *Attorney, Agent, or Firm*—Banner & Witcoff, Ltd.

(57) ABSTRACT

A conveying roller is disposed downstream of a feeding roller in a conveying direction and conveys a sheet of recording medium to a printing position along a conveying path. A medium detecting unit is disposed between the feeding roller and the conveying roller along the conveying path and detects the sheet of the recording medium. A printing unit performs printing at the printing position. A target-rotational-amount setting unit sets a target rotational amount for feeding the sheet of the recording medium to the conveying roller, based on a rotational amount of the feeding roller measured from when the feeding roller begins feeding the sheet of the recording medium accommodated in the feeding cassette until the medium detecting unit detects the sheet of the recording medium. A controller controls the feeding roller to continue rotating until the rotational amount of the feeding roller reaches the target rotational amount.

6 Claims, 7 Drawing Sheets

PRINTING DEVICE THAT RELIABLY FEEDS RECORDING MEDIUM FROM FEEDING CASSETTE TO CONVEYING ROLLER

CROSS REFERENCE TO RELATED APPLICATIONS

This application claims priority from Japanese Patent Application No. 2006-052972 filed Feb. 28, 2006. The entire content of the priority application is incorporated herein by reference.

TECHNICAL FIELD

The invention relates to a printing device, and particularly to a printing device that feeds a sheet of recording medium supplied from a feeding cassette to a conveying roller.

BACKGROUND

Printing devices that feed sheets of a recording paper stacked in a feeding cassette to a printing position one sheet at a time, where an image-recording unit prints an image on the paper, are well known in the art. This type of printing device generally includes a feeding roller for repeatedly feeding the topmost sheet of recording paper stacked in the feeding cassette along a conveying path one sheet at a time. Once the feeding roller has fed the sheet of paper along the conveying path to a conveying roller, the conveying roller continues conveying the paper to the printing position. The printing device prints images on the recording paper using a recording head that ejects ink onto the paper, for example.

Since the feeding distance from the cassette to the conveying roller is fixed, it should be possible to feed the recording paper appropriately from the cassette to the conveying roller by determining the rotational amount required by the feeding roller. However, in reality, the feeding roller sometimes slips over the recording paper. The amount of slippage varies according to wear on the feeding roller, ambient temperature and humidity, and the type of recording paper. If the amount of slippage is large, the recording paper may not reach the conveying roller simply by rotating the feeding roller a rotational amount equivalent to the feeding distance. If the feeding roller stops before the recording paper has reached the conveying roller, the conveying roller cannot begin conveying the recording paper, leaving the paper stuck in the conveying path. In such a case, the user must open the cover of the printing device to extract the recording paper from the conveying path.

A variety of methods have been proposed to ensure the recording paper reaches the conveying roller. For example, a printing device disclosed in Japanese Patent Application Publication No. 5-155086 adjusts the rotational amount of the feeding roller based on the thickness of the recording paper. Further, a printing device disclosed in Japanese Patent Application Publication No. 9-52421 includes a positional sensor for detecting passage of the leading and trailing edges of the recording paper and calibrates the rotational amount of the motor for feeding subsequent sheets of recording paper, based on the rotational amount of the motor required to convey the trailing edge of the recording paper past the positional sensor after the leading edge was detected.

SUMMARY

However, the printing devices described above still cannot ensure that the recording paper reaches the conveying roller.

The printing device disclosed in Japanese Patent Application Publication No. 5-155086, for example, simply sets the rotational amount of the conveying roller based on the thickness of the recording paper without consideration for other factors. Hence, the recording paper may still not reach the conveying roller in some cases, since this printing device does not account for fluctuations in slippage due to wear on the feeding roller and the like.

Further, a mixture of different types of recording paper may be stacked in the feeding cassette. Since the printing device disclosed in Japanese Patent Application Publication No. 9-52421 finds the amount of slippage based on the first sheet of recording paper fed from the feeding cassette and calibrates the feeding of subsequent sheets based on this slippage. Therefore, if the amount of slippage differs for each sheet of recording paper, the printing device may not be able to feed the recording paper to the conveying roller in some cases. Further, even if the recording paper stacked in the feeding cassette is all the same type of paper, the first sheet of paper fed onto the conveying path that is used to find the amount of slippage may not reach the conveying roller in some cases since calibration has not yet been performed for that sheet.

On the other hand, it is conceivable to provide a printing device with means fox feeding all sheets of recording paper uniformly at a target feeding amount set sufficiently larger than the feeding distance from the feeding cassette to the conveying roller. In such a case, the conveying roller is halted or rotated in the direction opposite the conveying direction during the feeding operation. In this way, even if the target feeding amount is set sufficiently larger than the feeding distance, progress of the recording paper is halted when the leading edge of the paper contacts the conveying roller, thereby ensuring that all sheets of the recording paper are fed to the appropriate position and axe not fed too far not stopped short. However, a printing device with this configuration conveys the recording paper an excessive target conveying amount even in cases where there is little slippage. Hence, the time required to perform the conveying operation is uniformly long.

In view of the foregoing, it is an object of the invention to provide a printing device capable of reliably feeding a recording medium from a feeding cassette to a conveying roller, while minimizing the time required for the feeding operation.

In order to attain the above and other objects, the invention provides a printing device. The printing device includes a feeding cassette, a feeding roller, a conveying roller, a medium detecting unit, a printing unit, a target-rotational-amount setting unit, and a controller. The feeding cassette is configured to accommodate at least one sheet of a recording medium. The feeding roller feeds a sheet of the recording medium accommodated in the feeding cassette along a conveying path in a conveying direction. The conveying roller is disposed downstream of the feeding roller in the conveying direction and conveys the sheet of the recording medium fed by the feeding roller to a printing position along the conveying path. The medium detecting unit is disposed between the feeding roller and the conveying roller along the conveying path and detects the sheet of the recording medium fed by the feeding roller. The printing unit performs printing on the sheet of the recording medium at the printing position. The target-rotational-amount setting unit sets a target rotational amount for feeding the sheet of the recording medium to the conveying roller, based on a rotational amount of the feeding roller measured from when the feeding roller begins feeding the sheet of the recording medium accommodated in the feeding cassette until the medium detecting unit detects the sheet of the recording medium. The controller controls the feeding roller to continue rotating until the rotational amount of the feeding roller reaches the target rotational amount.

BRIEF DESCRIPTION OF THE DRAWINGS

Illustrative aspects in accordance with the invention will be described in detail with reference to the following figures wherein.

DETAILED DESCRIPTION

A printing device according to an embodiment of the invention will be described while referring to FIGS. 1 through 7C.

Figure 1:
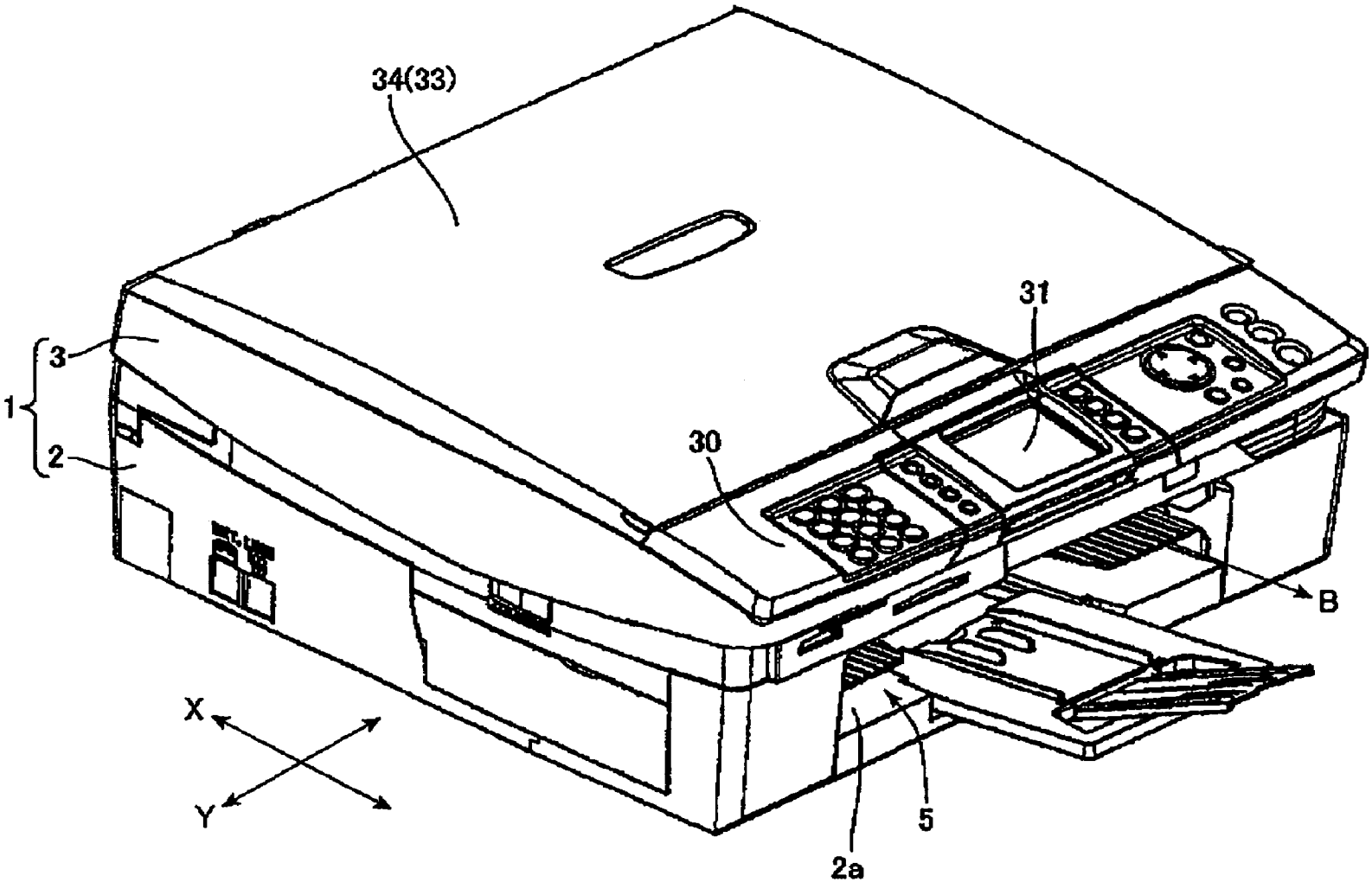
FIG. 1 is a perspective view showing a multifunction device according to an embodiment of the invention.

FIG. 1 is a perspective view showing a multifunction device 1 according to the embodiment. The multifunction device 1 shown in FIG. 1 has a facsimile function, printer function, copier function, scanner function, and the like. The multifunction device 1 is configured of a main case 2 that is substantially box-shaped and open on the top, and an upper case 3 disposed on top of the main case 2 and capable of swinging open and closed about the swing axis of hinges or the like (not shown) provided on one side of the main case 2. In the following description, the near side of the multifunction device 1 in FIG. 1 will be referred to as the front, while the left-to-right direction (main scanning direction and Y direction), front-to-tear direction (subscanning direction and X direction), and vertical direction will be based on the orientation of the multifunction device 1 shown in FIG. 1. The main case 2 and upper case 3 are formed of a synthetic resin according to an injection molding process.

A control panel 30 is provided on the top surface of the upper case 3 and the front end thereof. The control panel 30 includes various buttons, including numerical buttons, a Start button, and functional buttons. The user manipulates these buttons to perform various operations. The control panel 30 also includes a liquid crystal display (LCD) 31 for displaying the settings and status of the multifunction device 1 and various operational messages as needed.

A scanner 33 is disposed in the upper case 3 to the rear of the control panel 30. The scanner 33 has a flatbed scanning unit with a large glass plate on which an original to be scanned is placed, and a cover 34 capable of rotating over the flatbed scanning unit to cover or expose the top surface thereof. The scanner 33 functions to read images from a facsimile original to be transferred to another facsimile device with the facsimile function or an original to be copied with the copy function.

While not shown in the drawings, a line-type contact image sensor is disposed beneath the glass plate of the flatbed scanning unit. The contact image sensor is one example of a photoelectric conversion device for scanning the image surface of an original placed on the glass plate. The cover 34 is capable of swinging open and closed about hinges provided on the rear surface side of the multifunction device 1 (far side in FIG. 1).

As shown in FIG. 1, a paper cassette 5 is provided in the left-to-right center of the main case 2. The paper cassette 5 can accommodate a plurality of sheets of a recording paper P in a stacked and substantially level state on the bottom surface thereof. The paper cassette 5 can be pulled out through an opening 2*a* formed in the front surface of the main case 2.

Figure 2:
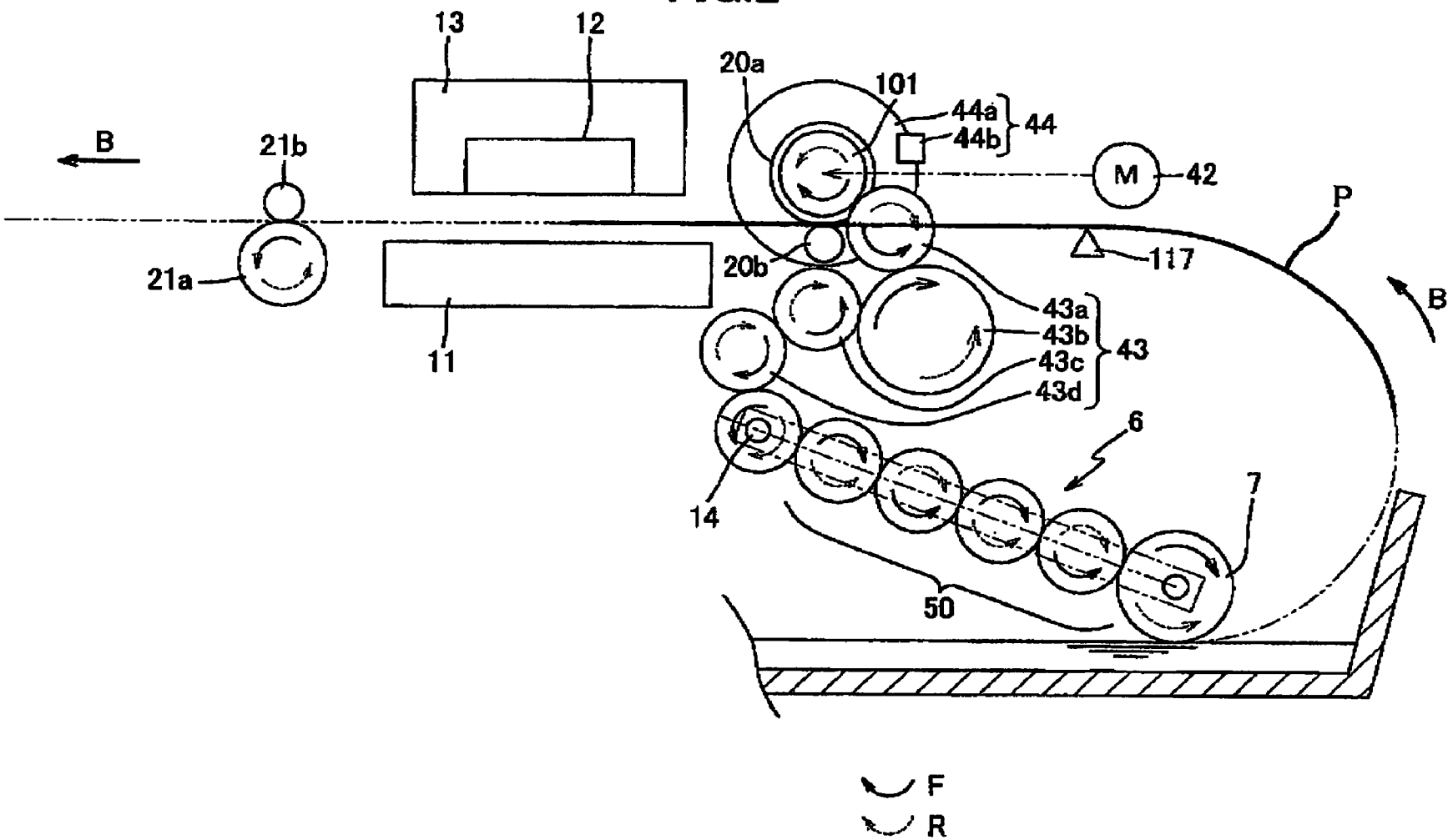
FIG. 2 is a side view conceptually illustrating the internal structure of the multifunction device.

FIG. 2 is a side view conceptually illustrating the internal structure of the multifunction device 1. In FIGS. 1 and 2, an arrow B indicates the conveying (feeding direction of the recording paper P. As shown in FIG. 2, a feeding unit 6 is accommodated in the main case 2. The feeding unit 6 includes a feeding roller 7 disposed above the paper cassette 5. The feeding unit 6 is configured to feed sheets of the recording paper P along a conveying path formed in a U-shape in the rear end of the main case 2 so that the sheet is conveyed upward, inverted, and conveyed back in the forward direction (left in FIG. 2).

Positioned downstream of the U-shaped section of the conveying path with respect to the conveying direction of the recording paper P (B direction) are provided a conveying roller 20*a* fox conveying the recording paper P, and a pinch roller 20*b* fox pressing the recording paper against the conveying roller 20*a*. Working together, the conveying roller 20*a* and pinch roller 20*b* pinch and convey the sheets of recording paper P. A flat platen 11 is disposed downstream of the conveying roller 20*a* and pinch roller 20*b* for supporting the sheets of recording paper P conveyed by the conveying roller 20*a* and pinch roller 20*b*.

Further downstream of the platen 11 in the conveying direction of the recording paper P are provided a discharge roller 21*a* for receiving sheets of recording paper P conveyed from the conveying roller 20*a* and for discharging the sheets from the main case 2, and a pinch roller 21*b* for pressing the recording paper P against the discharge roller 21*a*. The discharge roller 21*a* discharges the printed recording paper P through an opening formed downstream of the discharge roller 21*a* and pinch roller 21*b*. Further, a recording head 12 is positioned above the platen 11 between the conveying roller 20*a* and discharge roller 21*a* and above the conveying path along which the recording paper P is conveyed. The recording head 12 is mounted in a carriage 13 that can reciprocate in the main scanning direction (direction orthogonal to the plane of the drawing in FIG. 2). Nozzles (not shown) are formed in the recording head 12 on the recording paper P side for ejecting ink toward the recording paper P pinched by the conveying roller 20*a* and the like. The position on the platen 11 that confronts the nozzles of the recording head 12 serves as a printing position.

Ink tanks for supplying ink to the recording head 12 are detachably mounted in an accommodating section (not shown) of the main case 2 from above. In the present embodiment, the recording head 12 is configured to perform color printing, and the accommodating section accommodates ink tanks in the four colors black, cyan, magenta, and yellow. However, the accommodating section may be configured to accommodate ink tanks for a greater or smaller number of colors. Flexible ink tubes connect the ink tanks to the recording head 12 for supplying ink thereto.

In the present embodiment, a linefeed motor 42 configured of a DC motor produces a rotational force for rotating the conveying roller 20*a*. The rotational force of the linefeed motor 42 is also transmitted to the discharge roller 21*a* and the feeding roller 7 via a drive gear 101 that rotates together with the conveying roller 20*a*. The mechanism for transmitting the drive force from the conveying roller 20*a* to the discharge roller 21*a* is well known, and is not shown in the drawings and will not be described herein.

As shown in FIG. 2, the driving force of the conveying roller 20*a* is transmitted via the drive gear 101 to a gear train 43 configured of a plurality of mating gears 43*a*, 43*b*, 43*c*, and 43*d*. The drive force is in turn transmitted via the gear train 43 to a drive shaft 14 of the feeding unit 6 (feeding arm). Next, the driving force of the drive shaft 14 is transmitted to the feeding roller 7 via a gear train 50 configured of a plurality of mating gears.

In the present embodiment, rotation of the linefeed motor 42 in a direction driving the conveying roller 20*a* to convey the recording paper P in the conveying direction B is called a forward rotation, and rotation of the linefeed motor 42 in a direction driving the conveying roller 20*a* to convey the recording paper P in the direction opposite the conveying direction B (the direction for returning the recording paper P toward the paper cassette 5) is called a reverse rotation. In FIG. 2 arrows formed of solid lines (arrows F) indicate the rotational direction of each roller and gear during a forward rotation of the linefeed motor 42, while arrows formed of dotted lines (arrows R) indicate the rotational direction during a reverse rotation of the linefeed motor 42.

When the linefeed motor 42 rotates in reverse, the conveying roller 20*a* rotates counterclockwise in FIG. 2. Accordingly, the feeding roller 7 is driven to rotate in the feeding direction (counterclockwise in FIG. 2) through the gear train 50 of the feeding unit 6. In this way, the feeding roller 7 begins to feed the topmost sheet of the recording paper P stacked in the paper cassette 5.

After the sheet of recording paper P fed from the paper cassette 5 reaches the conveying roller 20*a*, the linefeed motor 42 rotates forward a prescribed amount. This is a cueing operation in which the recording paper P becomes pinched between the conveying roller 20*a* and pinch roller 20*b* and is conveyed below the recording head 12. The cueing operation is an operation for setting the recording paper P in a position where printing can begin by advancing the leading edge of the recording paper P to a prescribed position over the platen 11. During the cueing operation, the feeding roller 7 rotates in the direction opposite the feeding direction (clockwise in FIG. 2). However, since the nip force between the conveying roller 20*a* and pinch roller 20*b* is set greater than the conveying force of the feeding roller 7, the feeding roller 7 does not return the recording paper P to the paper cassette 5, but rather the conveying roller 20*a* and pinch roller 20*b* gripping the leading edge of the recording paper P convey the recording paper P forward as the recording paper P slips over the outer surface of the feeding roller 7.

Next, the conveying roller 20*a* begins advancing the recording paper P intermittently, while the recording head 12 mounted on the carriage 13 begins printing by ejecting ink through the nozzles onto one surface of the recording paper P as the carriage 13 reciprocates in the main scanning direction. As shown in FIG. 2, both the conveying roller 20*a* and the discharge roller 21*a* rotate in the conveying direction of the recording paper P when advancing the recording paper P intermittently.

After printing is complete fox one sheet of the recording paper P, the multifunction device 1 begins to discharge the printed sheet of recording paper P. At this time, the linefeed motor 42 rotates forward a prescribed amount sufficiently for continuously rotating the conveying roller 20*a* and discharge roller 21*a* in the discharging direction, after which the linefeed motor 42 is halted.

A rotary encoder 44 is also provided on one end of the conveying roller 20*a*. The rotary encoder 44 is configured of a slit plate 44*a* having slits (not shown) formed at prescribed intervals along the circumferential direction of the plate, and an optical sensor 44*b*. The optical sensor 44*b* converts light passing through the slits in the slit plate 44*a* to an electric signal and outputs the signal. Hence, the slits in the slit plate 44*a* can be detected based on the electric signal outputted from the optical sensor 44*b*.

The slit plate 44*a* rotates coaxially with the conveying roller 20*a*. As described above, the linefeed motor 42 rotates the conveying roller 20*a*, and the rotation of the conveying roller 20*a* in turn is transmitted to the feeding roller 7. Hence, by counting the number of slits detected by the rotary encoder 44, it is possible to calculate not only the rotational amount of the conveying roller 20*a*, but also the rotational amounts of the linefeed motor 42 and the feeding roller 7. In the present embodiment, the rotational amount of the feeding roller 7 is described as a value equivalent to the conveyed distance of the recording paper P fed by the feeding roller 7 under ideal conditions in which no slippage occurs between the feeding roller 7 and recording paper P.

A paper sensor 117 is also disposed upstream of the conveying roller 20*a* in the paper-conveying direction. The paper sensor 117 detects the leading and trailing edges of the recording paper P after the recording paper P passes through the U-shaped section of the conveying path and approaches the printing position. The position of the recording paper P along the conveying path can be determined based on detections by the paper sensor 117.

Figure 3:
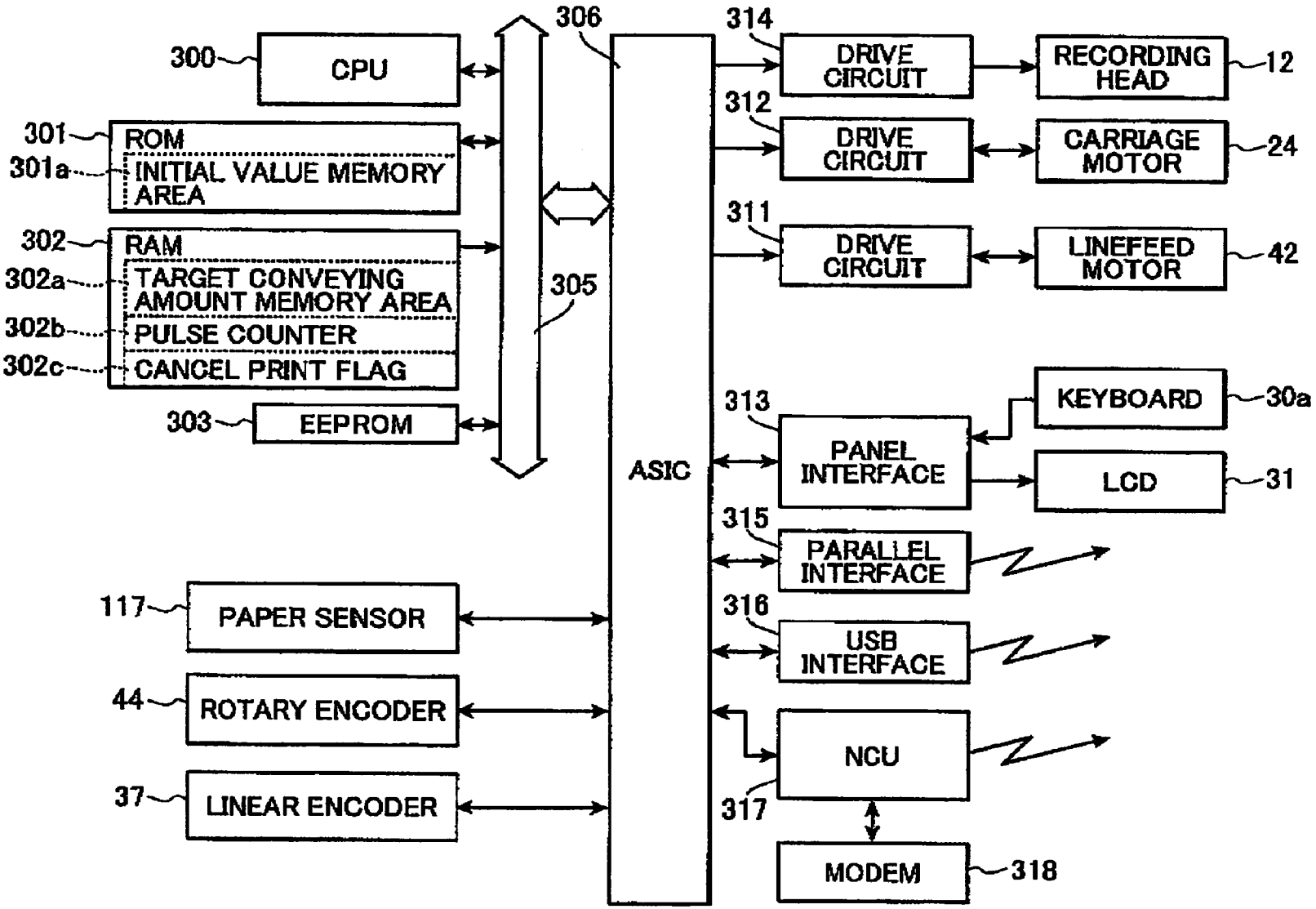
FIG. 3 is a block diagram showing the primary electrical structure of the multifunction device.

FIG. 3 is a block diagram showing the primary electrical structure of the multifunction device 1 described above. As shown in FIG. 3, the multifunction device 1 includes a CPU 300, a ROM 301, a RAM 302, and a EEPROM 303 that are all connected to an ASIC (application specific integrated circuit) 306 via a bus 305. The multifunction device 1 also includes the paper sensor 117, the rotary encoder 44, a linear encoder 37, the recording head 12, a drive circuit 314 for driving the recording head 12, a carriage motor 24, a drive circuit 312 for driving the carriage motor 24, the linefeed motor 42, a drive circuit 311 for driving the linefeed motor 42, a keyboard 30*a*, the LCD 31, a panel interface 313 connected to the keyboard 30*a* and the LCD 31, a parallel interface 315, a USB interface 316, and a NCU (network control unit) 317.

The CPU 300 is a central processing unit that controls overall operations of the multifunction device 1. The CPU 300 executes various programs, including a program for implementing the processes shown in FIGS. 4 through 6. The ROM 301 is a non-rewritable memory storing various control programs, including a program for implementing the operations in FIGS. 4 through 6, and data required by the CPU 300 when executing the control programs. The ROM 301 includes an initial value memory area 301*a* storing an initial target conveying amount. The initial value memory area 301*a* stores a value written to a target conveying amount memory area 302*a* of the RAM 302 described later as an initial value for a feeding process described later in FIG. 5.

The RAM 302 temporarily stores programs and data required for various processes executed by the CPU 300. The RAM 302 includes the target conveying amount memory area 302*a* mentioned above, a pulse counter 302*b*, and a cancel print flag 302*c*. The target conveying amount memory area 302*a* is used for storing a value (target rotational amount) for controlling the rotational amount of the feeding roller 7 in the feeding process (FIG. 5) described later. At the beginning of the feeding process in FIG. 5 described later, the CPU 300 reads the value stored in the initial value memory area 301*a* and writes this value to the target conveying amount memory area 302*a* as the initial value, A calibration value is later added to this initial value based on the rotational amount of the feeding roller 7 when the paper sensor 117 detects the leading edge of the recording paper P fed from the paper cassette 5.

The pulse counter 302*b* counts the number of slits detected by the rotary encoder 44. The pulse counter 302*b* is initialized to "0" at the beginning of the feeding process in FIG. 5 and is subsequently incremented by "1" each time the rotary encoder 44 detects another slit.

The cancel print flag 302*c* indicates whether or not to cancel the printing operation. The cancel print flag 302*c* is set to OFF in the feeding process of FIG. 5 as long as the recording paper P is fed normally from the paper cassette 5, but is set to ON when the paper cassette 5 has run out of the recording paper P so that a sheet of recording paper P cannot be fed properly.

The ASIC 306 is also connected to the NCU 317 having a modem 318. A communication signal received by the NCU 317 from a public network is first demodulated by the modem 318 and then inputted into the ASIC 306. Further, when the ASIC 30.6 transmits image data externally for a facsimile transmission or the like, the modem 318 modulates the image data to produce a communication signal and outputs this signal to the public network via the NCU 317.

In addition, the ASIC 306 generates a phase excitation signal or the like for energizing the linefeed motor 42, for example, based on commands from the CPU 300 and applies this signal to the drive circuit 311 of the linefeed motor 42 and the drive circuit 312 of the carriage motor 24, thereby supplying a drive signal to the linefeed motor 42 and carriage motor 24 via the drive circuit 311 and drive circuit 312 for controlling the forward and reverse rotations of the linefeed motor 42 and carriage motor 24, halting the motors, and the like. The ASIC 306 is also connected to the drive circuit 314 that drives the recording head 12 to selectively eject ink onto the recording paper P at a prescribed timing. The ASIC 306 generates and outputs a signal based on a drive control procedure received from the CPU 300, and the drive circuit 314 controls the recording head 12 based on the signal outputted from the ASIC 306.

The ASIC 306 is also connected to the panel interface 313 for facilitating transmission and reception operations with the keyboard 30*a* and the LCD 31 of the control panel 30, and the parallel interface 315 and USB interface 316 fox exchanging data with a personal computer or other external device via a parallel cable or USB cable, respectively.

Further, the ASIC 306 is connected to the paper sensor 117 positioned upstream of the conveying roller 20*a* in the paper-conveying direction for detecting the leading and trailing edges of the recording paper P as the recording paper P is fed toward the printing position, the rotary encoder 44 for detecting rotational amounts of the conveying roller 20*a* and the feeding roller 7, and the linear encoder 37 fox detecting the amount that the carriage 13 moves in the main scanning direction and the current position of the carriage 13.

Figure 4:
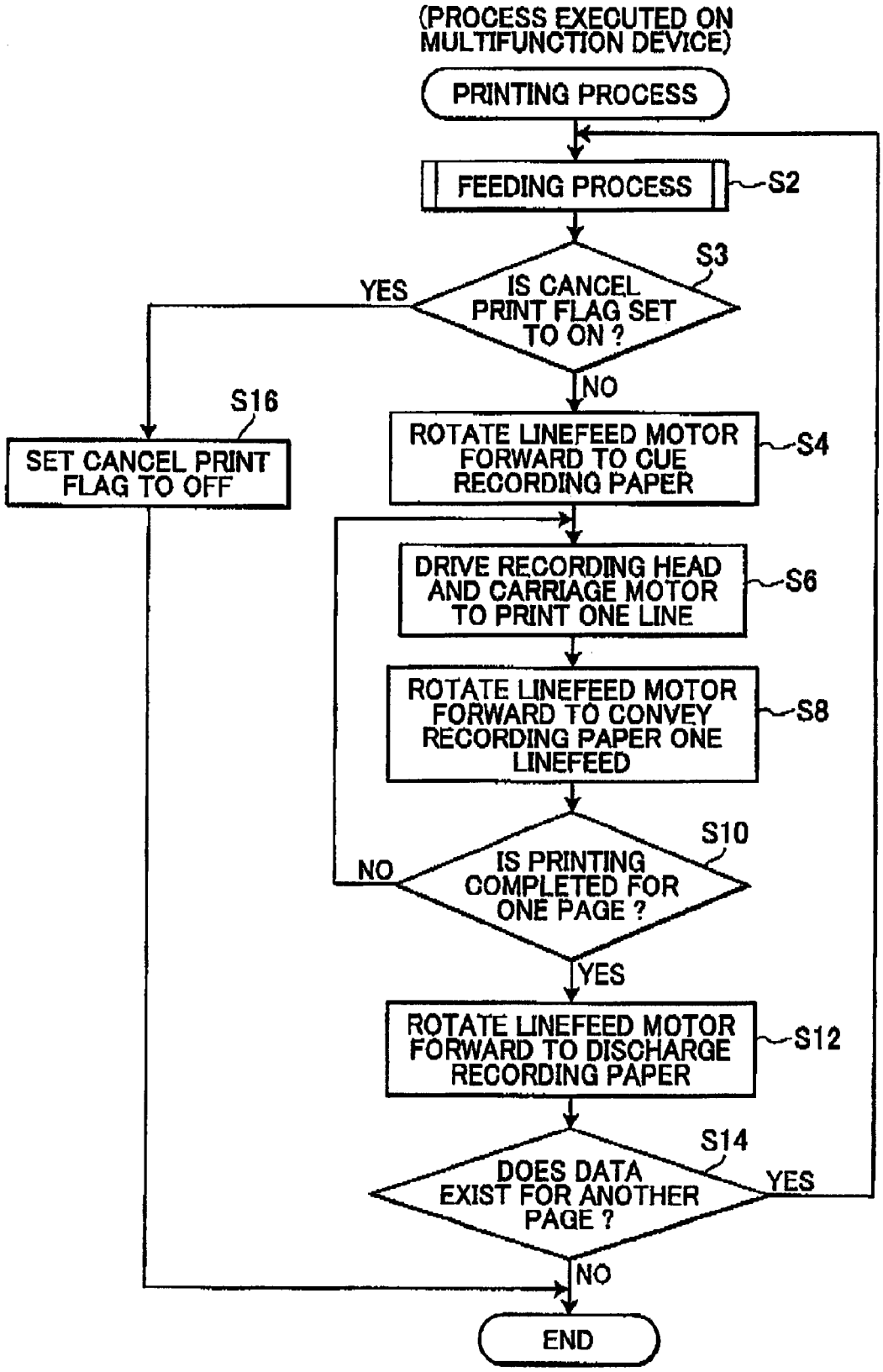
FIG. 4 is a flowchart illustrating steps in a printing process.

Next, processes executed on the multifunction device 1 of the present embodiment will be described with reference to the flowcharts in FIGS. 4 through 6. FIG. 4 is a flowchart illustrating steps in a printing process initiated when a print command is issued from an external device or the like (not shown).

In S2 of the process in FIG. 4, the CPU 300 of the multifunction device 1 executes a feeding process. The feeding process is described in detail with reference to FIG. 5. Through the feeding process, the feeding roller 7 separates and conveys the topmost sheet of recording paper P stacked in the paper cassette 5 until the leading edge of the sheet arrives at the conveying roller 20*a*. In S3 the CPU 300 determines whether the cancel print flag 302*c* is ON. If the recording paper P has not been fed normally from the paper cassette 5 in the feeding process of S2, then the cancel print flag 302*c* is ON (s3: YES). In this case, in S16 the CPU 300 turns off the cancel print flag 302*c* and ends the printing process.

However, if the recording paper P has been fed properly from the paper cassette 5 in the feeding process of S2, then the cancel print flag 302*c* is OFF (S3: NO). Hence, in S4 the CPU 300 drives the linefeed motor 42 in a forward rotation for a prescribed amount, rotating the conveying roller 20*a* in the paper-conveying direction (clockwise in FIG. 2) so that the recording paper P pinched between the conveying roller 20*a* and pinch roller 20*b* is cued.

In S6 the CPU 300 drives the recording head 12 and carriage 13 to print one line on the recording paper P. In SB the CPU 300 drives the linefeed motor 42 in a forward rotation a prescribed amount, rotating the conveying roller 20*a* in the paper-conveying direction and conveying the recording paper P by one linefeed. In S10 the CPU 300 determines whether the current page has been completely printed. If the page has not been completely printed (510: NO), then the CPU 300 returns to S6 and drives the recording head 12 and carriage 13 to print another line on the recording paper P.

After the current page has been completely printed (S10; YES), in S12 the CPU 300 drives the linefeed motor 42 in a forward rotation, rotating the conveying roller 20*a* and discharge roller 21*a* in the conveying direction until the printed recording paper P is discharged.

In S14 the CPU 300 determines whether print data remains for a subsequent sheet of recording paper P (the next page). If data remains (S14: YES), then the CPU 300 repeats the process from S2 to S14. Hence, the printing process in FIG. 4 feeds the recording paper P to the printing position one sheet at a time and prints images on each sheet.

Next, the feeding process of S2 will be described with reference to FIG. 5. FIG. 5 is a flowchart illustrating steps in this conveying process.

Figure 5:
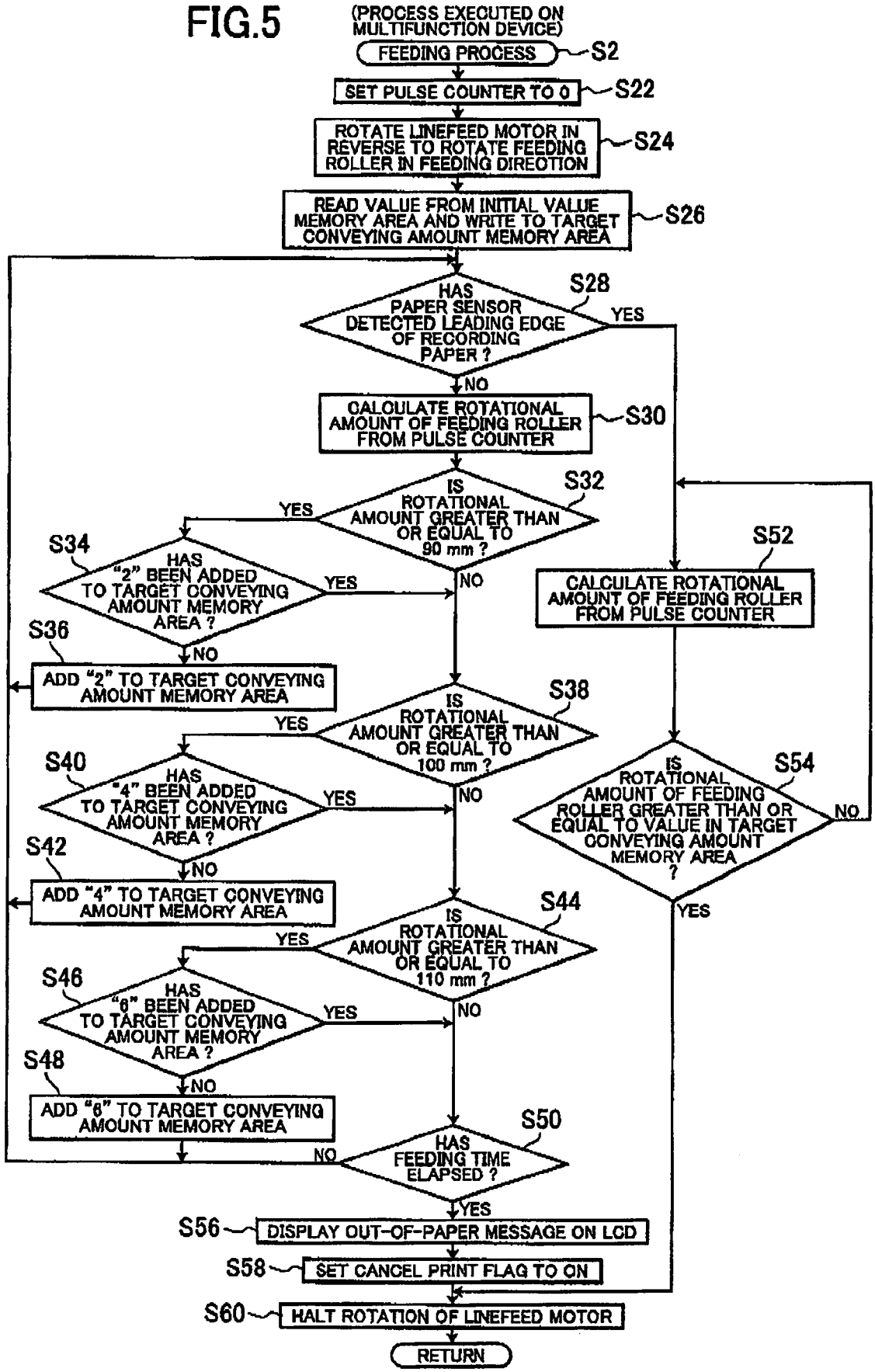
FIG. 5 is a flowchart illustrating steps in a feeding process.

In S22 of the process in FIG. 5, the CPU 300 initializes the pulse counter 302*b* to "0", In S24 the CPU 300 drives the linefeed motor 42 in a reverse rotation, rotating the feeding roller 7 in the feeding direction. Consequently, the feeding roller 7 separates and feeds the topmost sheet of recording paper P from the paper cassette 5. In S26 the CPU 300 reads the value in the initial value memory area 301*a* and writes this value to the target conveying amount memory area 302*a*.

In S28 the CPU 300 determines whether the paper sensor 117 has detected the leading edge of the recording paper P. Since the leading edge of the recording paper P fed from the paper cassette 5 has not yet reached the paper sensor 117 the first time the determination in S28 is made (S28: NO), the CPU 300 advances to S30. In S30 the CPU 300 calculates the rotational amount of the feeding roller 7 from the value of the pulse counter 302*b*. As described above, the pulse counter 302*b* is set to "0" at the start of the feeding process and is subsequently incremented by "1" each time a new slit in the rotary encoder 44 is detected. Therefore, the CPU 300 can calculate the rotational amount of the feeding roller 7 from the start of the feeding process (in other words, the beginning of the current operation for feeding the recording paper P) to the current time based on the value of the pulse counter 302*b*.

In S32 the CPU 300 determines whether the rotational amount of the feeding roller 7 calculated in S30 is greater than or equal to 90 mm. If the rotational amount of the feeding roller 7 to the current position is less than 90 mm (S32: NO) and, hence, is less than 100 mm (S38: NO) and less than 110 mm (s44: NO), then in S50 the CPU 300 determines whether a prescribed feeding time has elapsed. If the prescribed feeding time has not yet elapsed (S50: NO), then the CPU 300 returns to S28 and repeats the process described above.

If the paper sensor 117 has still not detected the leading edge of the recording paper P (S28, NO) but the rotational amount of the feeding roller 7 calculated in S30 is greater than or equal to 90 mm (S32: YES), then in S34 the CPU 300 determines whether a calibration value of "2" has been added to the target conveying amount memory area 302*a*. If the calibration value of "2" has not yet been added to the target conveying amount memory area 302*a* (S34: NO), then in S36 the CPU 300 adds the calibration value of "2" to the value of the target conveying amount memory area 302*a* and repeats the above process from S28. However, if the calibration value of "2" has already been added to the target conveying amount memory area 302*a* (S34: YES), then the CPU 300 advances to the process in S38. Hence, the CPU 300 adds the calibration value of "2" to the target conveying amount memory area 302*a* only one time when the rotational amount of the feeding roller 7 has reached 90 mm.

While repeating the process described above, if the 117 has still not detected the leading edge of the recording paper P (S28: NO), but the rotational amount of the feeding roller 7 has reached (i.e., greater than or equal to) 100 mm (s38: YES), then in S40 the CPU 300 determines whether a calibration value of "4" has been added to the target conveying amount memory area 302*a*. If the calibration value of "4" has not yet been added to the target conveying amount memory area 302*a* (S40: NO), then in S42 the CPU 300 adds the calibration value of "4" to the value of the target conveying amount memory area 302*a* and repeats the above process from S28. However, if the calibration value of "4" has already been added to the target conveying amount memory area 302*a* (S40: YES), then the CPU 300 advances to the process in S44, Hence, the CPU 300 adds the calibration value of "4" to the target conveying amount memory area 302*a* only one time when the rotational amount of the feeding roller 7 has reached 100 mm. Since the calibration value of "2" has been added once to the target conveying amount memory area 302*a* when the rotational amount of the feeding roller 7 reached 90 mm, as described above, a total calibration value of "6" is added to the initial value written to the target conveying amount memory area 302*a* (the value read from the initial value memory area 301*a*) when the rotational amount of the feeding roller 7 has reached 100 mm.

While repeating the process described above, if the 117 has still not detected the leading edge of the recording paper P (S28: NO), but the rotational amount of the feeding roller 7 has reached (i.e., greater than or equal to) 110 mm (S44: YES), then in S46 the CPU 300 determines whether a calibration value of "6" has been added to the target conveying amount memory area 302*a*. If the calibration value of "6" has not yet been added to the target conveying amount memory area 302*a* (S46: NO), then in S48 the CPU 300 adds the calibration value of "6" to the value of the target conveying amount memory area 302*a* and repeats the above process from S28. However, if the calibration value of "6" has already been added to the target conveying amount memory area 302*a* (S46: YES), then the CPU 300 advances to the process in S50. Hence, the CPU 300 adds the calibration value of "6" to the target conveying amount memory area 302*a* only one time when the rotational amount of the feeding roller 7 has reached (i.e., greater than or equal to) 110 mm. Since the calibration values of "2" and "4" have been added once to the target conveying amount memory area 302*a* when the rotational amount of the feeding roller 7 reached 90 mm and 100 mm, respectively, a total calibration value of "12" is added to the initial value written to the target conveying amount memory area 302*a* when the rotational amount of the feeding roller 7 has reached 110 mm.

If the leading edge of the recording paper P arrives at the paper sensor 117 while repeating the process described above, the paper sensor 117 detects the leading edge of the recording paper P. Next, the process performed when the paper sensor 117 detects the leading edge of the recording paper P will be described. When the paper sensor 117 detects the leading edge of the recording paper P (S28: YES), then in S52 the CPU 300 calculates the rotational amount of the feeding roller 7 from the pulse counter 302*b*. In S54 the CPU 300 determines whether the rotational amount of the feeding roller 7 calculated in S52 is greater than or equal to the value stored in the target conveying amount memory area 302*a*. If the rotational amount of the feeding roller 7 is less than the value stored in the target conveying amount memory area 302*a* (S54: NO), then the CPU 300 repeats the process in S52.

The processes of S52 and 554 are repeated while the feeding roller 7 continues to feed the recording paper P until the rotational amount of the feeding roller 7 calculated from the pulse counter 302*b* is greater than or equal to the value stored in the target conveying amount memory area 302*a* (S54: YES). Then, the CPU 300 halts the rotation of the linefeed motor 42 in S60 and ends the feeding process.

As described above, the rotational amount of the feeding roller 7 calculated from the beginning of the feeding process until the leading edge of the recording paper P arrives at the paper sensor 117 is larger when there is a larger amount of slippage between the feeding roller 7 and the recording paper P. The larger the rotational amount of the feeding roller 7, the greater the value set in the target conveying amount memory area 302*a*. Accordingly, by continuing to rotate the linefeed motor 42 until the rotational amount of the feeding roller 7 reaches the value stored in the target conveying amount memory area 302*a*, the multifunction device 1 can reliably feed the recording paper P to the conveying roller 20*a*, even when slippage between the recording paper P and the feeding roller 7 is great.

While repeating the process described above, if the CPU 300 determines in S50 that the prescribed feeding time has elapsed since the feeding roller 7 started rotation in S24 (S50: YES) while the paper sensor 117 has not yet detected the leading edge of the recording paper P (S28: NO), indicating that the leading edge of the recording paper P has not yet arrived at the paper sensor 117 even though the feeding roller 7 has rotated continuously for the prescribed feeding time or greater, then it can be determined that there is no recording paper P remaining in the paper cassette 5 and, hence, a sheet could not be fed properly.

Therefore, in S56 the CPU 300 informs the user that the multifunction device 1 is out of paper by displaying a message on the LCD 31. In S58 the CPU 300 sets the cancel print flag 302*c* (see FIG. 3) to ON and in S60 halts the rotation of the linefeed motor 42, thereby ending the feeding process. By setting the cancel print flag 302*c* to ON in S58, the CPU 300 can recognize that the printing operation has been canceled in S3 of the printing process described above (see FIG. 4).

Figure 6:
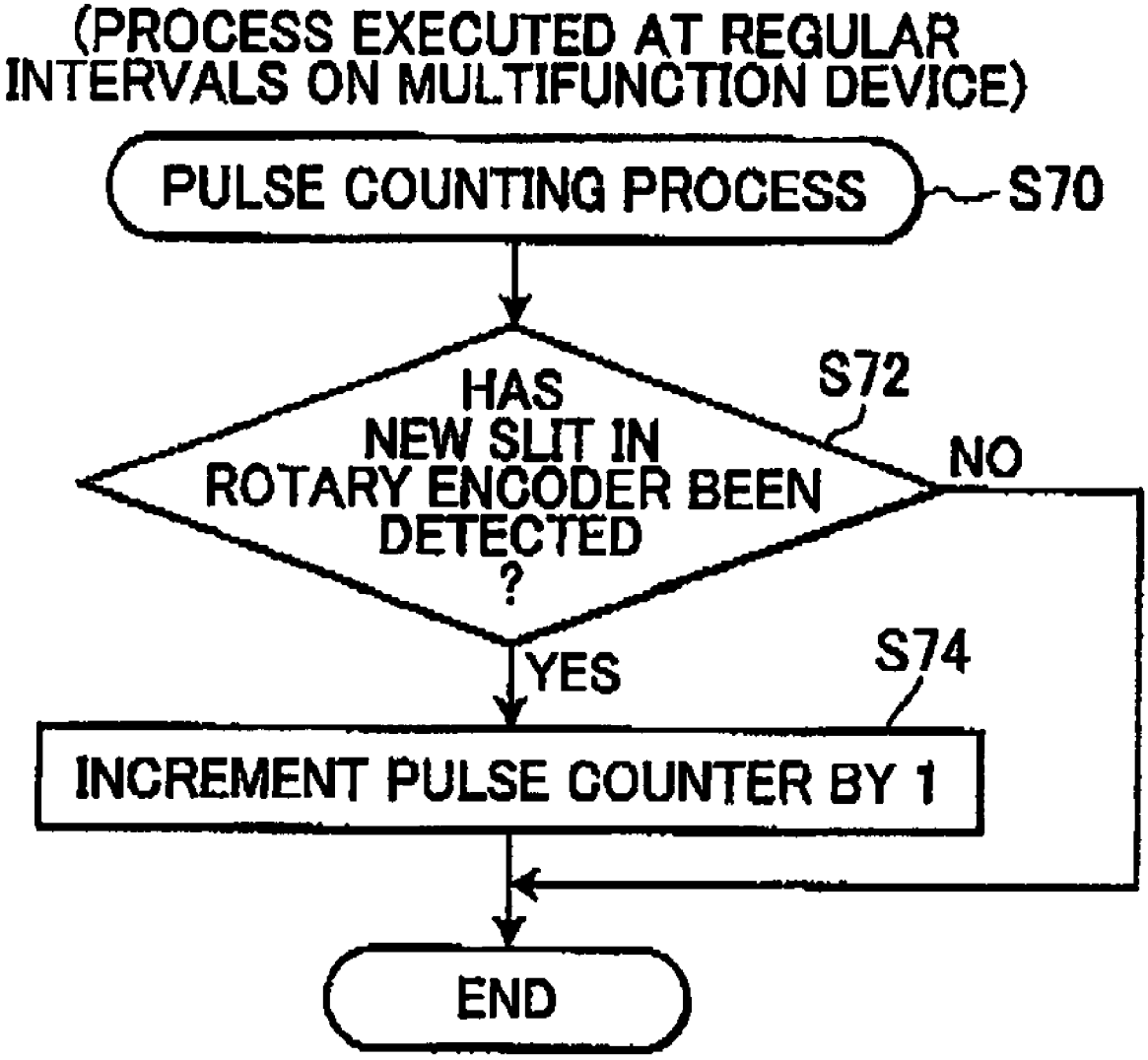
FIG. 6 is a flowchart illustrating steps in a pulse counting process executed by the multifunction device.

FIG. 6 is a flowchart illustrating steps in a pulse counting process S70 executed on the multifunction device 1. The pulse counting process shown in FIG. 6 is an interrupt process executed at regular intervals on the multifunction device 1. The intervals at which the pulse counting process is executed are sufficiently shorter than the time required for the slit plate 44*a* of the rotary encoder 44 to rotate an interval of one slit.

In S72 of the pulse counting process in FIG. 6, the CPU 300 determines whether a new slit in the rotary encoder 44 has been detected. If a new slit has been detected (S72: YES), then in S74 the CPU 300 increments the pulse counter 302*b* (see FIG. 3) by "1". However, if a new slit has not been detected (S72: NO), then the CPU 300 ends the pulse counting process. Through the pulse counting process, the CPU 300 can store the number of slits detected in the rotary encoder 44 in the pulse counter 302*b*.

Figure 7A:
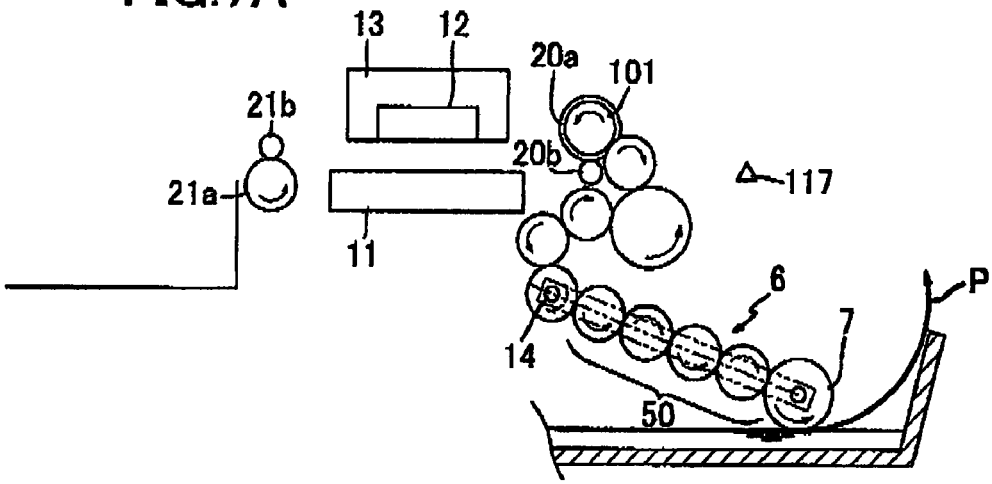
FIG. 7A is a side view conceptually illustrating the progress of a recording paper during the feeding process, wherein a leading edge of the recording paper has been fed out of a paper cassette.
Figure 7B:
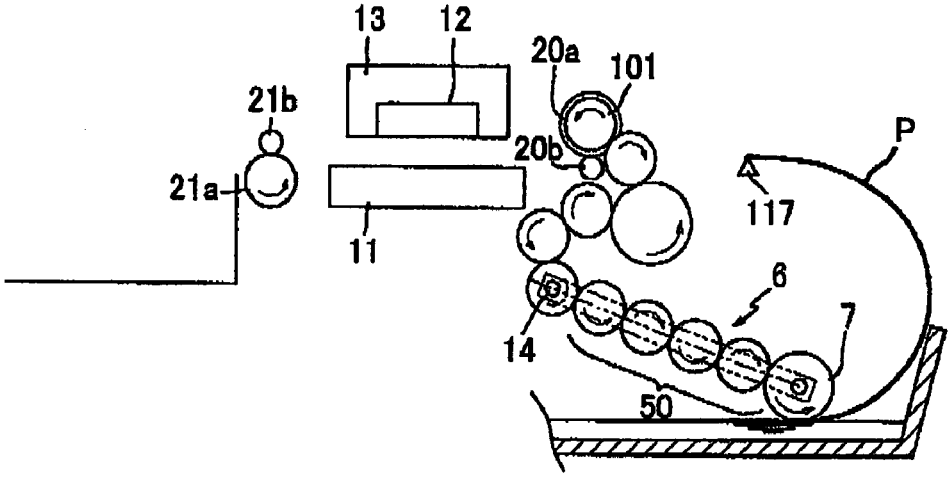
FIG. 7B is a side view conceptually illustrating the progress of the recording paper during the feeding process, wherein the leading edge of the recording paper has arrived at a paper sensor.
Figure 7C:
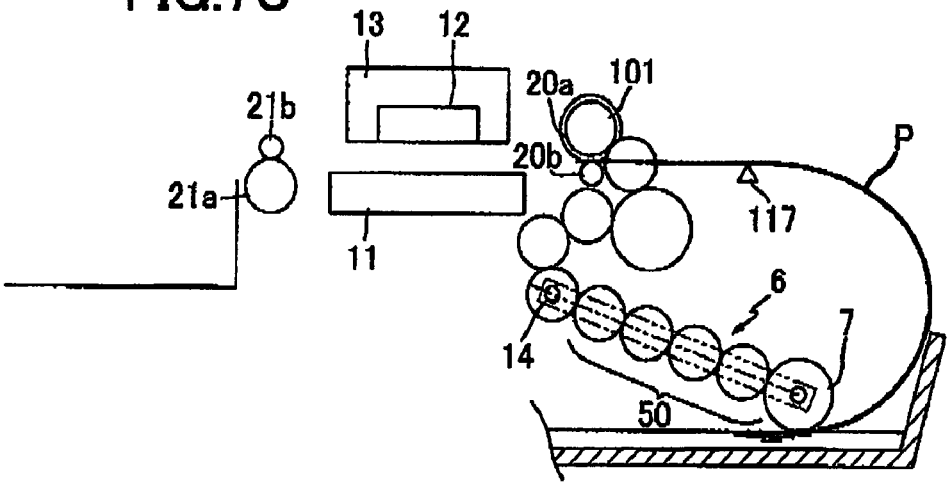
FIG. 7C is a side view conceptually illustrating the progress of the recording paper during the feeding process, wherein the leading edge of the recording paper has arrived at a conveying roller.

Next, the feeding process of S2 described above for feeding a sheet of the recording paper P will be described with reference to FIGS. 7A through 7C. FIGS. 7A through 7C show the progress of the recording paper P during the feeding process. As shown in FIG. 7A, the leading edge of the recording paper P has been fed out of the paper cassette 5. In FIG. 7B, the leading edge of the recording paper P has arrived at the paper sensor 117. In FIG. 7*c*, the leading edge of the recording paper P has arrived at the conveying roller 20*a*. The linefeed motor 42 and rotary encoder 44 shown in FIG. 2 have been omitted from FIGS. 7A through 7C.

In the feeding process of S2, the linefeed motor 42 is rotated in reverse, rotating the feeding roller 7 in the feeding direction. At this time, the feeding roller 7 begins to pick up and feed the topmost sheet of the recording paper P from the paper cassette 5, as shown in FIG. 7A. The feeding roller 7 continues feeding the recording paper P until the leading edge of the recording paper P passes the paper sensor 117, as shown in FIG. 7B, and arrives at the conveying roller 20*a*, as shown in FIG. 7C.

According to the feeding process in S2 of the present embodiment, a calibration value is added to the target conveying amount memory area 302*a* (see FIG. 3) based on the amount that the feeding roller 7 rotates when conveying a sheet of the recording paper P from the paper cassette 5 until the paper sensor 117 detects the leading edge of the recording paper P. If there is a large amount of slippage between the feeding roller 7 and the recording paper P during this feeding process, then the feeding roller 7 will have to rotate a greater amount until the paper sensor 117 detects the leading edge of the recording paper P. However, if little slippage occurs between the feeding roller 7 and recording paper P, then the rotational amount of the feeding roller 7 performed before the paper sensor 117 detects the leading edge of the recording paper P will be smaller.

Therefore, by incrementing the value stored in the target conveying amount memory area 302*a* with a calibration value based on the rotational amount of the feeding roller 7 required to feed the recording paper P from the paper cassette 5 until the paper sensor 117 detects the leading edge of the recording paper P, the state shown in FIG. 7B, the value in the target conveying amount memory area 302*a* can be set to a value reflecting the amount of slippage that occurs between the feeding roller 7 and the recording paper P. Thereafter, the multifunction device 1 controls the rotation of the feeding roller 7 to continue until the rotational amount reaches the value stored in the target conveying amount memory area 302*a* to ensure that the recording paper P fed from the paper cassette 5 is reliably conveyed to the conveying roller 20*a*, the state shown in FIG. 7*c*.

Since the value in the target conveying amount memory area 302*a* is set for each sheet of recording paper P fed by the feeding roller 7, each sheet can be reliably fed to the conveying roller 20*a*, even if the paper cassette 5 accommodates a mixture of types of recording paper P.

Further, the conveying roller 20*a* rotates in a reverse direction for returning the recording paper P toward the paper cassette 5 while the feeding roller 7 is rotating in the feeding direction. Accordingly, the recording paper P will not pass the conveying roller 20*a* while being fed by the feeding roller 7, ensuring that the recording paper P is reliably fed to the appropriate position.

While the invention has been described in detail with reference to the above aspects thereof, it would be apparent to those skilled in the art that various changes and modifications may be made therein without departing from the spirit of the invention.

For example, the multifunction device 1 according to the embodiment described above has a single paper cassette 5, but the multifunction device 1 may include a plurality of paper cassettes. In this case, a suitable calibration value and an initial target conveying amount may be preset for each cassette, and the value of the target conveying amount memory area 302*a* can be set using the appropriate calibration value and initial target conveying amount.

Further, in the embodiment described above, the rotational amount of the feeding roller 7 is calculated based on the value of the pulse counter 302*b*. However, the rotational amount of the feeding roller 7 may be set to the value of the pulse counter 302*b* itself.

Further, the multifunction device 1 in the embodiment described above is an inkjet printer that prints by ejecting ink onto the recording paper P. However, the invention may be applied to a laser printer that exposes a cylindrical photosensitive drum, deposits toner on the exposed regions of the drum, and transfers the toner image onto the recording paper P.

In the case of the laser printer, conveyance is halted after feeding the recording paper P from the paper cassette to the paper sensor. Subsequently, the recording paper P is conveyed again to a transfer point on the photosensitive drum by setting a print start area of the recording paper P to a leading edge of the toner image developed on the photosensitive drum. The toner deposited on the photosensitive drum is then transferred onto the recording paper P at the transfer point of the photosensitive drum. Hence, the recording paper P can be reliably fed to the transfer point of the photosensitive drum.

What is claimed is:

1. A printing device comprising:

a feeding cassette that is configured to accommodate at least one sheet of a recording medium;

a feeding roller that feeds a first sheet of the recording medium accommodated in the feeding cassette along a conveying path in a conveying direction;

a conveying roller that is disposed downstream of the feeding roller in the conveying direction and that conveys the first sheet of the recording medium fed by the feeding roller to a printing position along the conveying path;

a medium detecting unit that is disposed between the feeding roller and the conveying roller along the conveying path and that detects the first sheet of the recording medium fed by the feeding roller;

a printing unit that performs printing on the first sheet of the recording medium at the printing position;

a target-rotational-amount setting unit that sets a target rotational amount for feeding the first sheet of the recording medium to the conveying roller, based on a rotational amount of the feeding roller measured from when the feeding roller begins feeding the first sheet of the recording medium accommodated in the feeding cassette until the medium detecting unit detects the first sheet of the recording medium; and a controller that controls the feeding roller to continue rotating until the rotational amount of the feeding roller reaches the target rotational amount, thereby feeding the first sheet of the recording medium detected by the medium detecting unit to the conveying roller;

further comprising a rotational-amount detecting unit that detects the rotational amount of the feeding roller, wherein the controller includes:

a leading-edge determining section that determines whether the medium detecting unit has detected a leading edge of the sheet of the recording medium;

a first calculating section that calculates the rotational amount of the feeding roller based on detection results of the rotational-amount detecting unit, when the leading-edge determining section determines that the leading edge has not yet reached the medium detecting unit;

a threshold determining section that determines whether the rotational amount of the feeding roller calculated by the first calculating section is greater than or equal to a predetermined threshold value; and a calibration-value adding section that adds a predetermined calibration value to the target rotational amount when the threshold determining section determines that the rotational amount is greater than or equal to the predetermined threshold value.

2. The printing device according to claim 1, wherein the target-rotational-amount setting unit sets the target rotational amount each time the feeding roller feeds a sheet of the recording medium.

3. The printing device according to claim 1, wherein the controller controls the conveying roller to rotate in a reverse direction during a time period in which the controller controls the feeding roller to continue rotating, the reverse direction being a direction for conveying the recording medium opposite the conveying direction.

4. The printing device according to claim 1, wherein the threshold determining section includes a plurality of threshold determining sections including:

a first threshold determining section that determines whether the rotational amount is greater than or equal to a first threshold value; and a second threshold determining section that determines whether the rotational amount is greater than or equal to a second threshold value greater than the first threshold value; and wherein the calibration-value adding section includes a plurality of calibration-value adding sections including:

a first calibration-value adding section that adds a first calibration value to the target rotational amount only at one time for the sheet of the recording medium, when the first threshold determining section determines that the rotational amount is greater than or equal to the first threshold value; and a second calibration-value adding section that adds a second calibration value to the target rotational amount only at one time for the sheet of the recording medium, when the second threshold determining section determines that the rotational amount is greater than or equal to the second threshold value, the second calibration value being greater than the first calibration value.

5. The printing device according to claim 1, wherein the controller further includes:

a second calculating section that calculates the rotational amount of the feeding roller based on detection results of the rotational-amount detecting unit, when the leading-edge determining section determines that the leading edge has reached the medium detecting unit;

a target determining section that determines whether the rotational amount of the feeding roller calculated by the second calculating section is greater than or equal to the target rotational amount;

a repeating section that repeats calculation of the rotational amount by the second calculating section, when the target determining section that determines that the rotational amount is less than the target rotational amount, thereby controlling the feeding roller to continue rotating for feeding the sheet of the recording medium; and a halting section that halts rotation of the feeding roller when the target determining section determines that the rotational amount is greater than or equal to the target rotational amount.

6. The printing device according to claim 1, wherein the controller further includes:

a feeding-time determining section that determines whether a predetermined feeding time has elapsed since the feeding roller begins feeding the sheet of the recording medium, when the medium detecting unit has not detected the leading edge; and a cancel-print-flag setting section that sets a cancel print flag that indicates whether to cancel a printing operation when the feeding-time determining section determines that the predetermined feeding time has elapsed.

* * * * *